US012338038B1

(12) United States Patent
Xia et al.

(10) Patent No.: US 12,338,038 B1
(45) Date of Patent: Jun. 24, 2025

(54) MULTIFUNCTIONAL DOUBLE DRINKING CUP COVER

(71) Applicant: ZHEJIANG FEIJIAN TECHNOLOGY CO., LTD., Zhejiang (CN)

(72) Inventors: Feijian Xia, Zhejiang (CN); Chenhan Ouyang, Zhejiang (CN); Jinxiong Yan, Zhejiang (CN)

(73) Assignee: ZHEJIANG FEIJIAN TECHNOLOGY CO., LTD., Jinhua (CN)

( * ) Notice: Subject to any disclaimer, the term of this patent is extended or adjusted under 35 U.S.C. 154(b) by 0 days.

(21) Appl. No.: 18/885,544

(22) Filed: Sep. 13, 2024

(30) Foreign Application Priority Data

Jul. 8, 2024 (CN) ..... 202410908456.1
Jul. 8, 2024 (CN) ..... 202421615823.0

(51) Int. Cl.

| | |
|---|---|
| ***B65D 47/06*** | (2006.01) |
| ***B65D 39/16*** | (2006.01) |
| ***B65D 43/02*** | (2006.01) |
| ***B65D 51/18*** | (2006.01) |
| ***B65D 51/24*** | (2006.01) |

(Continued)

(52) U.S. Cl.
CPC ..... *B65D 47/06* (2013.01); *B65D 39/16* (2013.01); *B65D 43/0225* (2013.01); *B65D 51/18* (2013.01); *B65D 51/242* (2013.01); *A45F 3/16* (2013.01); *A47G 19/2222* (2013.01); *A47G 21/18* (2013.01); *B65D 2251/1058* (2013.01); *B65D 2517/0049* (2013.01); *B65D 2543/00046* (2013.01)

(58) Field of Classification Search
CPC ..... B65D 43/0225; B65D 39/16; B65D 2543/00046; B65D 47/06; B65D 51/242; B65D 2251/1058; B65D 2517/0049; B65D 43/16; B65D 51/18; A47G 19/222; A47G 21/18; A45F 3/16
USPC ..... 220/703, 705, 707
See application file for complete search history.

(56) References Cited

U.S. PATENT DOCUMENTS 10,159,368 B2 * 12/2018 Lin ..... B65D 43/16
10,524,597 B2 * 1/2020 Sorensen ..... A47J 43/27

(Continued)

FOREIGN PATENT DOCUMENTS

CN 216822667 U * 6/2022
CN 216932652 U * 7/2022
CN 221285307 U * 7/2024

*Primary Examiner* — Nathan J Jenness
*Assistant Examiner* — Jennifer Castriotta

(57) ABSTRACT

A multifunctional double drinking cup cover is provided, including a main cover, and an upper cover rotatably arranged on the main cover. A straight drinking nozzle is arranged on the main cover, a rotating cover is sleeved on the straight drinking nozzle, and the rotating cover rotates around the straight drinking nozzle. A drinking opening is formed on an upper surface of the rotating cover, the drinking opening is in communication with the straight drinking nozzle, and a limiting tube is arranged on an inner side wall of the drinking opening. A button is arranged on the main cover, a clamping groove is formed on the upper cover, and the upper cover rotates in a direction close to or away from the rotating cover. The upper cover, the button, and the rotating cover are movable between a closed state and an open state.

8 Claims, 5 Drawing Sheets

(51) Int. Cl.

| | |
|---|---|
| *A45F 3/16* | (2006.01) |
| *A47G 19/22* | (2006.01) |
| *A47G 21/18* | (2006.01) |

(56) References Cited

U.S. PATENT DOCUMENTS

| | | | | |
|---|---|---|---|---|
| 11,589,695 | B2 * | 2/2023 | Spivey | B65D 47/0833 |
| 11,975,896 | B2 * | 5/2024 | Omdahl, II | A47G 19/2272 |
| 12,012,264 | B2 * | 6/2024 | Hofmann | B65D 1/0246 |
| 2003/0168455 | A1 * | 9/2003 | Zettle | B65D 47/0895 220/714 |
| 2021/0267392 | A1 * | 9/2021 | Rechsteiner | B65D 51/1633 |

* cited by examiner

MULTIFUNCTIONAL DOUBLE DRINKING CUP COVER

TECHNICAL FIELD

The present disclosure relates to the technical field of cup covers, and particularly relates to a multifunctional double drinking cup cover.

BACKGROUND

A double drinking cup cover in the prior art usually includes a main cover and an upper cover that is foldably arranged on the main cover. The upper cover covers a straight drinking nozzle, and the upper cover or the main cover is opened to drink water. However, due to limited functionality, improvements thereto are required.

SUMMARY

In order to overcome the defects of cup covers in the prior art such as limited functionality, the present disclosure provides a new multifunctional double drinking cup cover.

In order to solve the above technical problem, the present disclosure is achieved by means of the following technical solution:

a multifunctional double drinking cup cover, includes a main cover and an upper cover rotatably arranged on the main cover; a straight drinking nozzle is arranged on the main cover, a rotating cover is sleeved on the straight drinking nozzle, and the rotating cover rotates around the straight drinking nozzle; a drinking opening is formed on an upper surface of the rotating cover, the drinking opening is communicated with the straight drinking nozzle, a limiting tube is arranged on an inner side wall of the drinking opening, a lower end of the limiting tube is arranged on a straw and communicated with the straw, and the rotating cover drives the straw to rotate; a button is arranged on the main cover, a clamping groove is formed on the upper cover, and the upper cover rotates in a direction close to or away from the rotating cover; the upper cover, the button and the rotating cover are in a closed state or an open state; in the closed state, an upper end of the button is inserted into the clamping groove and is in clamping fit with the upper cover, and the upper cover covers the rotating cover; a handle rotatably arranged on the main cover is further included, and a magnet is arranged inside the handle; the handle, the main cover and the upper cover are in a supporting state or an active state; and in the supporting state, the handle rotates upwards and abuts against the upper cover, and in the active state, the handle rotates downwards.

A user can drink water through the drinking opening and the straight drinking nozzle, or drink water through the limiting tube and the straw by rotating the rotating cover until the limiting tube and the straw are close to the button, which allows the user to drink water in different ways and environments conveniently. Limiting of the upper cover is achieved through the button. Through the handle, the magnet and the upper cover, the present disclosure achieves functions of a mobile phone support and enhances both entertainment and functionality of the double drinking cup cover.

Preferably, in the above multifunctional double drinking cup cover, a guide protruding strip is arranged on the straight drinking nozzle, and movable holes are formed on the guide protruding strip; guide blocks and a guide step are arranged on an inner side wall of the rotating cover; the straight drinking nozzle and the rotating cover are in a rotating state or an assembly state; in the rotating state, an upper surface of either of the guide blocks is fitted with a lower surface of the guide protruding strip, and the guide step is fitted with an upper surface of the guide protruding strip; the rotating cover is rotatably sleeved on the straight drinking nozzle through the guide blocks, the guide step and the guide protruding strip; and in the assembly state, the guide blocks and the movable holes are just aligned with each other, and the rotating cover moves upwards and drives the guide blocks to penetrate the movable holes.

The guide blocks, the guide step and the guide protruding strip, not only enable the rotating cover to rotate around the straight drinking nozzle, but also play a role of guide when rotating cover rotates, thus improving the stability of the rotating cover during rotation. The rotating cover can be removed from the straight drinking nozzle, which facilitates cleaning of the rotating cover.

Preferably, in the above multifunctional double drinking cup cover, first clamping blocks are arranged on the straight drinking nozzle, and a width of either of the first clamping blocks decreases in a direction away from the rotating cover; second clamping blocks are arranged on the inner side wall of the rotating cover, and a limiting groove is formed on the second clamping blocks; the first clamping blocks and the second clamping blocks are in a locking state or an unlocking state; in the locking state, the first clamping blocks are inserted into the limiting groove and abut against the second clamping blocks; and in the unlocking state, the first clamping blocks are detached from the limiting groove.

Through the first clamping blocks and the limiting groove, the rotating cover can be kept in the locking state, thus improving the stability of the straw and preventing rotation of the rotating cover when the user drinks water through the straw or the drinking opening.

Preferably, in the multifunctional double drinking cup cover, observation openings are formed on the rotating cover in a penetrating manner, and in the locking state, the observation openings and the first clamping blocks are just aligned with each other.

The observation openings facilitate the user in checking whether the first clamping blocks are inserted into the limiting groove, thus improving the smoothness of controlling the rotating cover to switch between the locking state and the unlocking state.

Preferably, in the multifunctional double drinking cup cover, protruding blocks are arranged on the rotating cover. The arrangement of the protruding blocks provides the user with a point of force application, thus facilitating rotation of the rotating cover by the user.

Preferably, in the multifunctional double drinking cup cover, a sealing ring is sleeved on the outer side wall of the straight drinking nozzle, and the inner side wall of the rotating cover abuts against the sealing ring.

The arrangement of the sealing ring increases the fitness between the straight drinking nozzle and the rotating cover, thus further enhancing the stability of the rotating cover.

Preferably, in the multifunctional double drinking cup cover, an upper end of the straight drinking nozzle is inclined towards a direction close to the button.

The above arrangement reduces a lifting amplitude of a bottom of a cup body when the user drinks water, thus improving the comfort of the user when drinking water.

Preferably, in the multifunctional double drinking cup cover, a sealing gasket is further included, a fixing column is arranged on the sealing gasket, and a fixing hole is formed on the upper cover, where an upper end of the fixing hole is larger than a lower end thereof in width. The fixing column is elastic, the fixing column and the fixing hole are matched in shape, and the fixing column is inserted into the fixing hole for fitting in an inserted manner. In the closed state, the sealing gasket abuts against the upper surface of the rotating cover.

An upper end of the fixing hole is larger than a lower end thereof in width, which improves the stability of the inserted fit between the fixing column and the fixing hole. The sealing gasket and the rotating cover can be detachably mounted through the fixing column and the fixing hole, thus facilitating removal and cleaning of the sealing gasket.

DETAILED DESCRIPTIONS OF THE EMBODIMENTS

Figure 1:
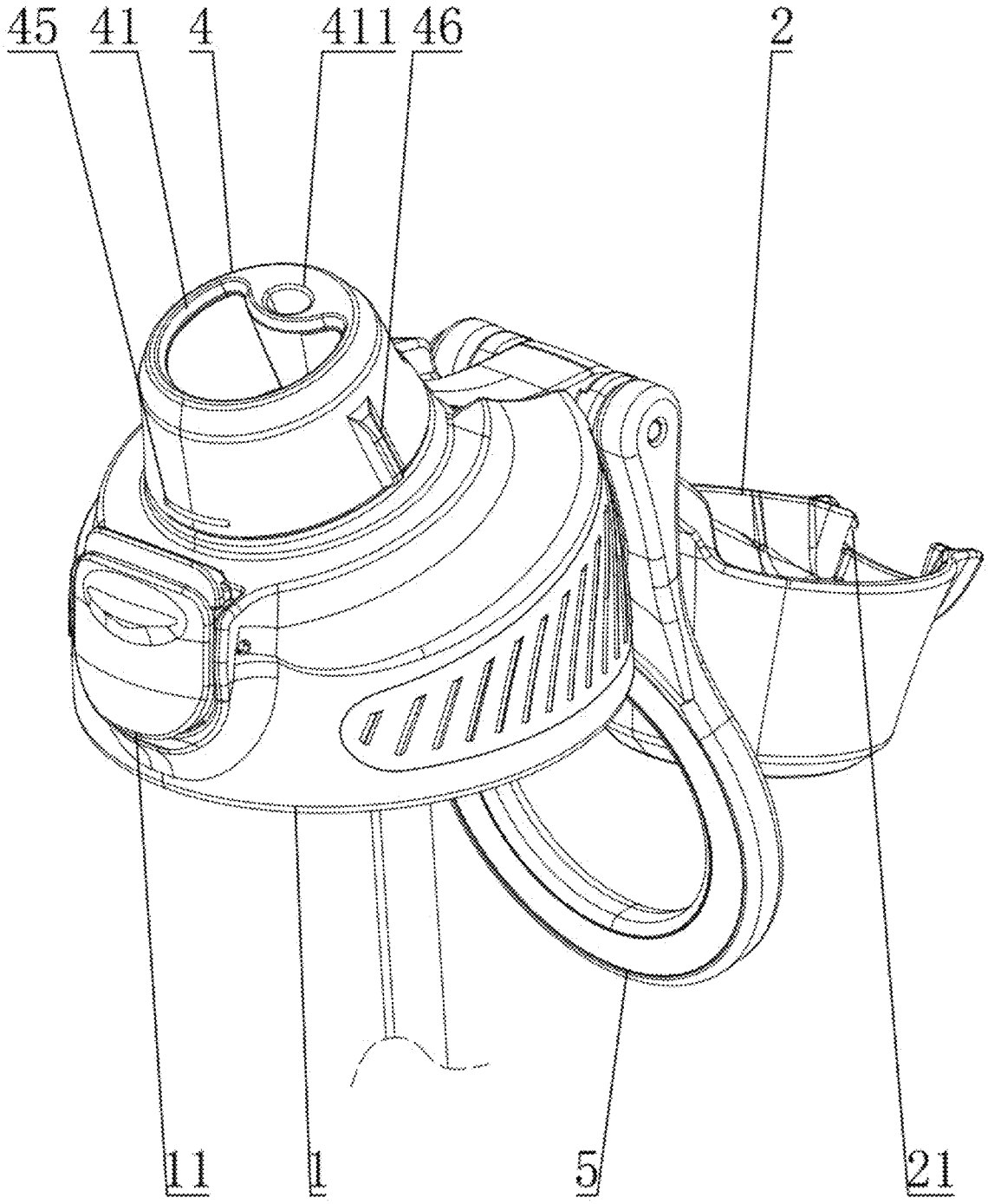
FIG. 1 is a structural schematic diagram of an upper cover, a button and a rotating cover in an open state of the present disclosure.

The present disclosure will be further described in detail with reference to FIGS. 1-5 and specific embodiments, but they are not intended to limit the present disclosure.

Embodiment 1

As shown in FIGS. 1-5, a multifunctional double drinking cup cover includes a main cover 1 and an upper cover 2 rotatably arranged on the main cover 1. A straight drinking nozzle 3 is arranged on the main cover 1, a rotating cover 4 is sleeved on the straight drinking nozzle 3, and the rotating cover 4 rotates around the straight drinking nozzle 3. A drinking opening 41 is formed on an upper surface of the rotating cover 4, the drinking opening 41 is communicated with the straight drinking nozzle 3, a limiting tube 411 is arranged on an inner side wall of the drinking opening 41, a lower end of the limiting tube 411 is arranged on a straw and communicated with the straw, and the rotating cover 4 drives the straw to rotate. A button 11 is arranged on the main cover 1, a clamping groove 21 is formed on the upper cover 2, and the upper cover 2 rotates in a direction close to or away from the rotating cover 4. The upper cover 2, the button 11 and the rotating cover 4 are in a closed state or an open state. In the closed state, an upper end of the button 11 is inserted into the clamping groove 21 and is in clamping fit with the upper cover 2, and the upper cover 2 covers the rotating cover 4. A handle 5 rotatably arranged on the main cover 1 is further included, and a magnet 51 is arranged inside the handle 5. The handle 5, the main cover 1 and the upper cover 2 are in a supporting state or an active state. In the supporting state, the handle 5 rotates upwards and abuts against the upper cover 2, and in the active state, the handle 5 rotates downwards.

Preferably, a guide protruding strip 31 is arranged on the straight drinking nozzle 3, and movable holes 311 are formed on the guide protruding strip 31. Guide blocks 42 and a guide step 43 are arranged on an inner side wall of the rotating cover 4. The straight drinking nozzle 3 and the rotating cover 4 are in a rotating state or an assembly state. In the rotating state, an upper surface of either of the guide blocks 42 is fitted with a lower surface of the guide protruding strip 31, and the guide step 43 is fitted with an upper surface of the guide protruding strip 31. The rotating cover 4 is rotatably sleeved on the straight drinking nozzle 3 through the guide blocks 42, the guide step 43 and the guide protruding strip 31. In the assembly state, the guide blocks 42 and the movable holes 311 are just aligned with each other, and the rotating cover 4 moves upwards and drives the guide blocks 42 to penetrate the movable holes 311.

Preferably, first clamping blocks 32 are arranged on the straight drinking nozzle 3, and a width of either of the first clamping blocks 32 decreases in a direction away from the rotating cover 4. Second clamping blocks 44 are arranged on the inner side wall of the rotating cover 4, and a limiting groove 441 is formed on the second clamping blocks 44. The first clamping blocks 32 and the second clamping blocks 44 are in a locking state or an unlocking state. In the locking state, the first clamping blocks 32 are inserted into the limiting groove 441 and abut against the second clamping blocks 44. In the unlocking state, the first clamping blocks 32 are detached from the limiting groove 441.

Preferably, observation openings 45 are formed on the rotating cover 4 in a penetrating manner. In the locking state, the observation openings 45 and the first clamping blocks 32 are just aligned with each other.

Preferably, protruding blocks 46 are arranged on the rotating cover 4.

Preferably, a sealing ring 33 is sleeved on the outer side wall of the straight drinking nozzle 3, and the inner side wall of the rotating cover 4 abuts against the sealing ring 33.

Preferably, an upper end of the straight drinking nozzle 3 is inclined towards a direction close to the button 11.

Preferably, a sealing gasket 6 is further included, a fixing column 61 is arranged on the sealing gasket 6, and a fixing hole 22 is formed on the upper cover 2, where an upper end of the fixing hole 22 is larger than a lower end thereof in width. The fixing column 61 is elastic, the fixing column 61 and the fixing hole 22 are matched in shape, and the fixing column 61 is inserted into the fixing hole 22 for fitting in an inserted manner. In the closed state, the sealing gasket 6 abuts against the upper surface of the rotating cover 4.

Specifically, to drink water, the button 11 is pressed, and in this case, the upper end of the button 11 will be detached from the clamping groove 21, thus releasing a fixed connection between the button 11 and the upper cover 2. A user can rotate the upper cover 2 downwards and drink water through the drinking opening 41.

Figure 4:
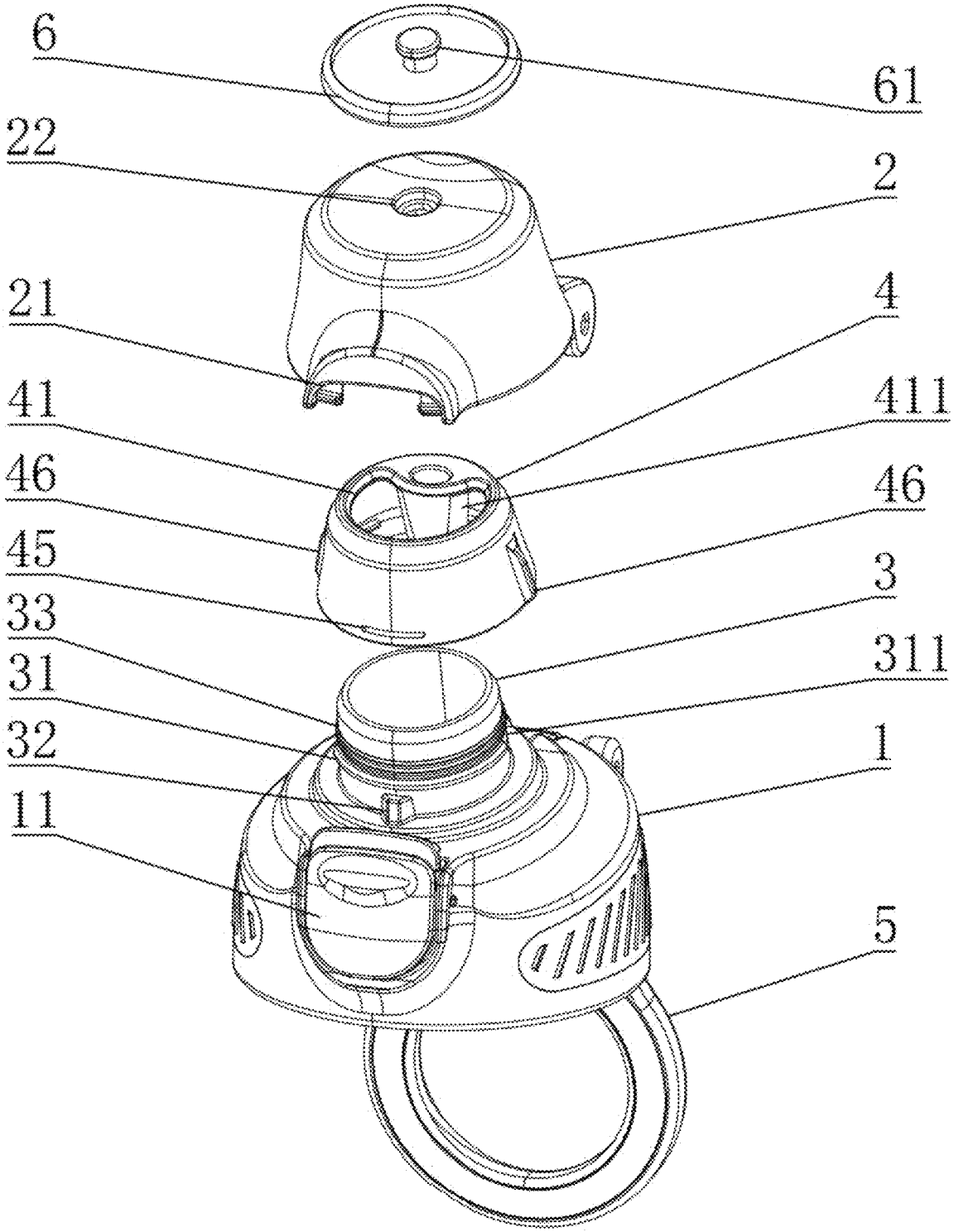
FIG. 4 is a schematic diagram of an explosive structure of the present disclosure.
Figure 5:
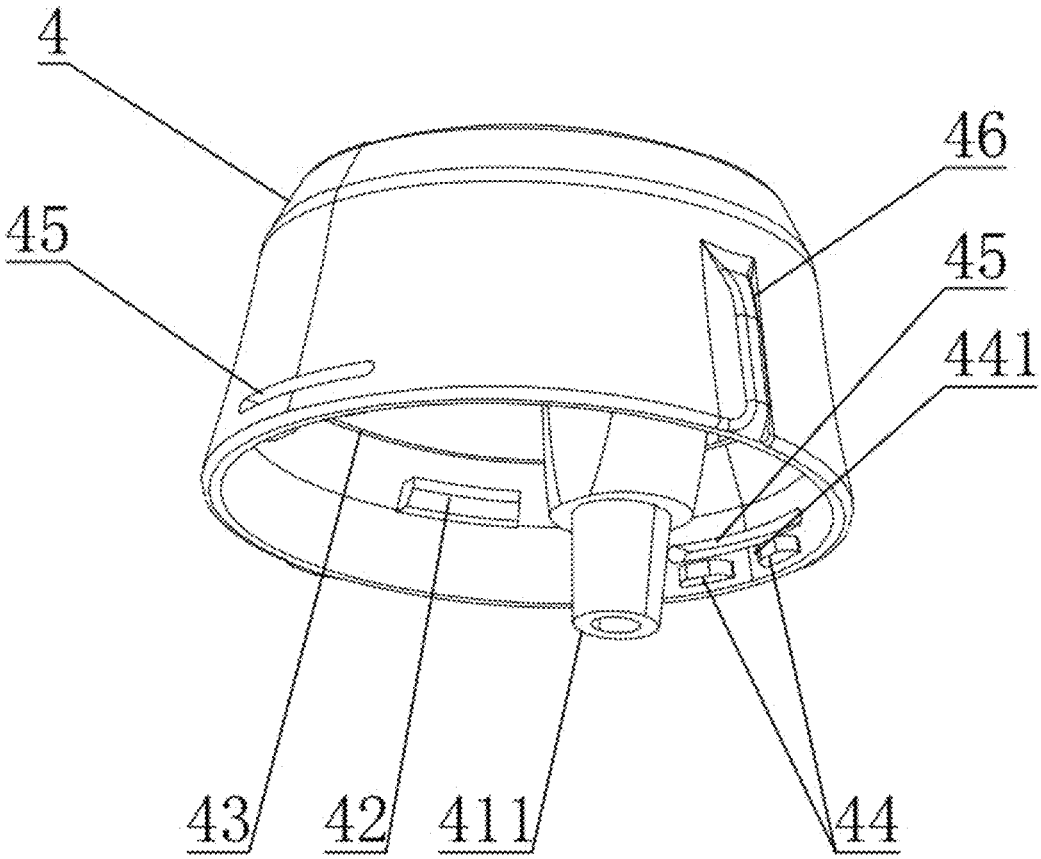
FIG. 5 is a structural schematic diagram of a rotating cover of the present disclosure.

As shown in FIGS. 1, 4 and 5, in the embodiments of the present disclosure, numbers of the movable holes 311, the first clamping blocks 32, the guide blocks 42, the second clamping blocks 44, the observation openings 45, and the protruding blocks 46 are all two. The observation openings 45 and the protruding blocks 46 are spaced apart from each other on an outer side wall of the rotating cover 4, the second clamping blocks 44 are in one-to-one correspondence with the observation openings 45 and distributed below the observation openings 45, and the limiting tube 411 is arranged on an inner side wall of the drinking opening 41 close to one of the observation openings 45.

When it is needed to install the rotating cover 4 on the straight drinking nozzle 3, the observation opening 45 away from the limiting tube 411 is aligned with the first clamping block 32 close to the button 11 first. Then, the rotating cover 4 is moved downwards until the guide step 43 tightly abuts against the guide protruding strip 31. As the rotating cover 4 is further moved, the rotating cover 4 undergoes elastic deformation due to extrusion by the guide protruding strip 31, and drives the guide blocks 42 to slide along the guide protruding strip 31. When the upper surface of either of the guide blocks 42 is fitted with the lower surface of the guide protruding strip 31, the rotating cover 4 is moved in place, and the first clamping blocks 32 are inserted into the limiting groove 441 and abut against the second clamping blocks 44. In this case, the rotating cover 4 can be installed on the straight drinking nozzle 3, and the user can drink water directly through the drinking opening 41.

To drink water through the straw as needed, the rotating cover 4 is rotated by 180 degrees first. In this case, the first clamping block 32 close to the button 11 is inserted into the limiting groove 441 close to the limiting tube 411, to fix the straw on a side close to the button 11. The user can then drink water through the limiting tube 411 and the straw.

When it is needed to remove the rotating cover 4 from the straight drinking nozzle 3, the rotating cover 4 is rotated and the rotating cover 4 is driven to move upwards simultaneously. When the guide blocks 42 are just aligned with the movable holes 311, the rotating cover 4 can be removed, to facilitate cleaning by the user.

Figure 2:
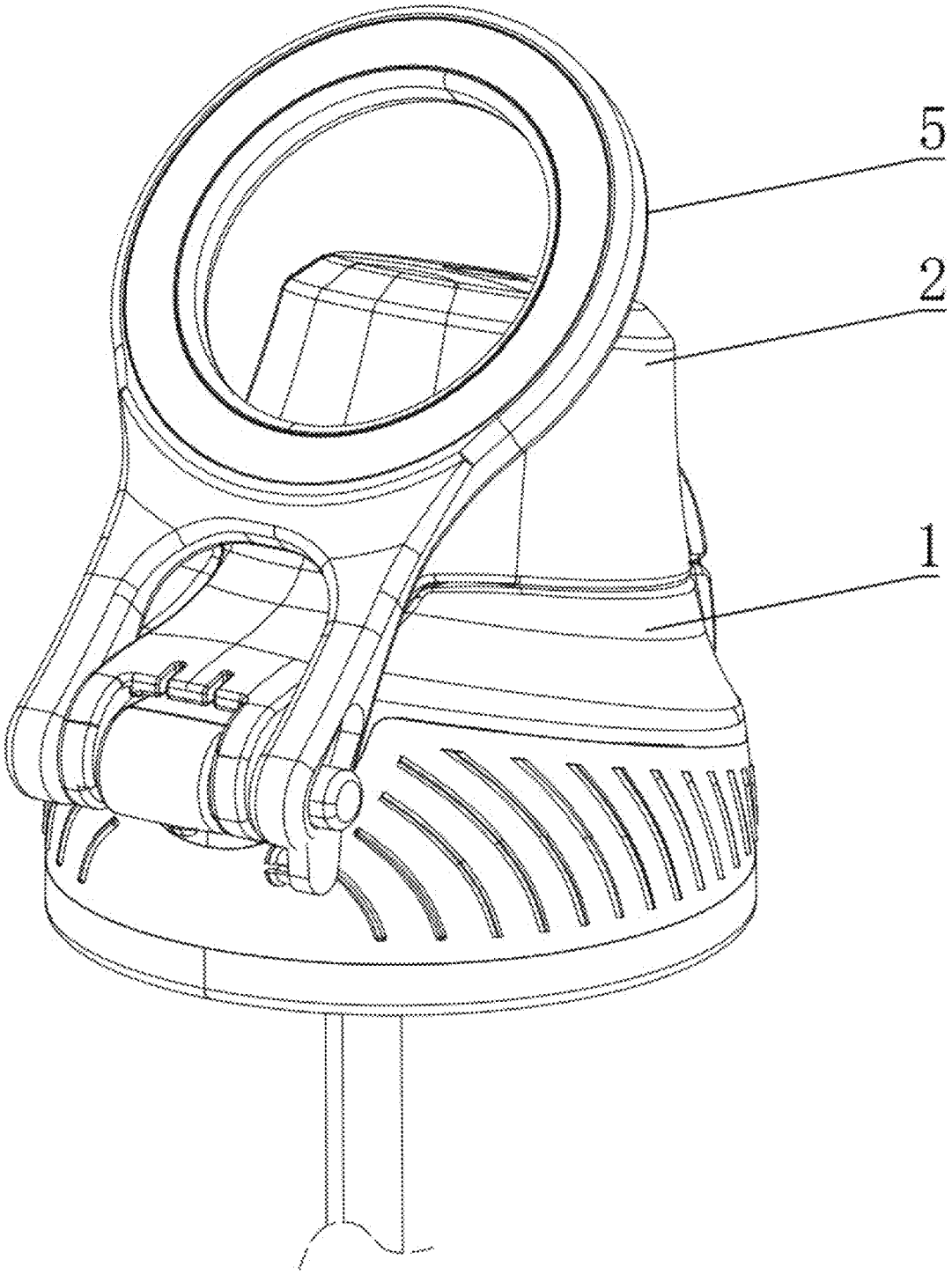
FIG. 2 is a structural schematic diagram of an upper cover, a button and a rotating cover in a closed state with a handle in a supporting state of the present disclosure.
Figure 3:
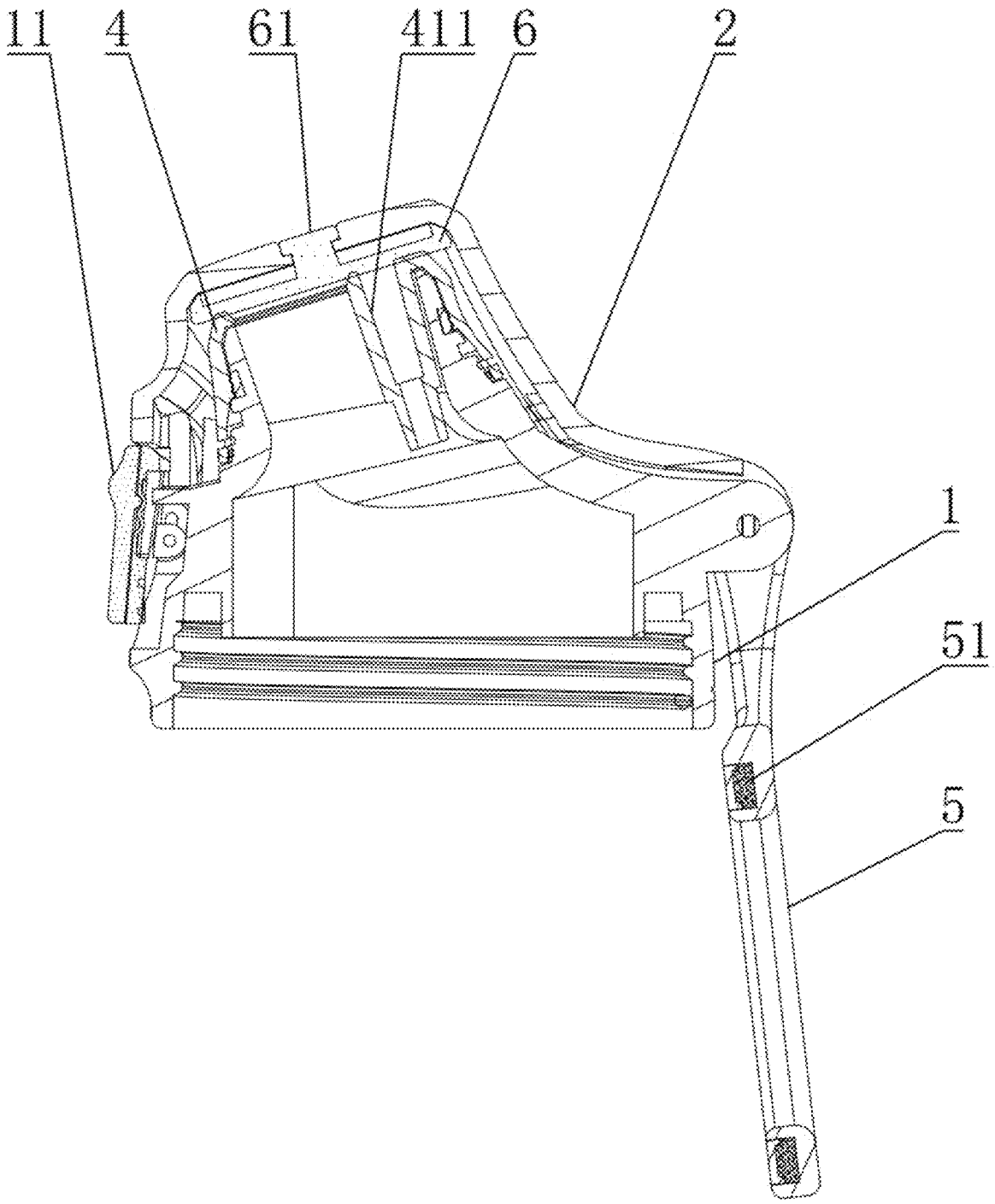
FIG. 3 is a sectional view of an upper cover, a button and a rotating cover in an open state of the present disclosure.

More specifically, as shown in FIGS. 2 and 3, the upper cover 2 includes a main body and a rotating arm, where the rotating arm and the main body form an obtuse angle, and the width of the main body is greater than a maximum inner diameter of the handle 5. When the handle 5 rotates upwards until the handle 5 abuts against the main body, the user can place a mobile phone on the rotating arm with a back of the mobile phone against the handle 5. In this case, the magnet 51 inside the handle 5 is capable of serving as a mobile phone support, which increases the entertainment value of the double drinking cup cover.

As shown in FIG. 1, an anti-slip pad is embedded into an outer side wall of the main cover 1, and anti-slip patterns are formed on the anti-slip pad, thus facilitating rotation of the main cover 1 by the user, and enhancing the comfort when the user rotates the main cover 1.

To sum up, the above descriptions are merely preferred embodiments of the present disclosure, and all equivalent changes and modifications made within the scope of claims of the present disclosure shall fall within the scope of the present disclosure.

What it claimed is:

1. A multifunctional double drinking cup cover, comprising a main cover and an upper cover rotatably arranged on the main cover;

wherein a straight drinking nozzle is arranged on the main cover, a rotating cover is sleeved on the straight drinking nozzle, and the rotating cover rotates around the straight drinking nozzle;

wherein a drinking opening is formed on an upper surface of the rotating cover, the drinking opening is in communication with the straight drinking nozzle, a limiting tube is arranged on an inner side wall of the drinking opening;

wherein a button is arranged on the main cover, a clamping groove is formed on the upper cover, and the upper cover rotates in a direction close to or away from the rotating cover;

wherein the upper cover, the button and the rotating cover are movable between a closed state and an open state; and in the closed state, an upper end of the button is inserted into the clamping groove and is clamped on the upper cover, and the upper cover covers the rotating cover; and wherein the multifunctional double drinking cup cover further comprises a handle rotatably arranged on the main cover, and a magnet is arranged inside the handle; and wherein the handle, the main cover and the upper cover are movable between a supporting state and an active state; and in the supporting state, the handle rotates upwards and abuts against the upper cover, and in the active state, the handle rotates downwards.

2. The multifunctional double drinking cup cover according to claim 1, wherein a guide protruding strip is arranged on the straight drinking nozzle, and movable holes are formed on the guide protruding strip;

wherein guide blocks and a guide step are arranged on an inner side wall of the rotating cover;

wherein the straight drinking nozzle and the rotating cover are movable between a rotating state and an assembly state; in the rotating state, an upper surface of either of the guide blocks is fitted with a lower surface of the guide protruding strip, and the guide step is fitted with an upper surface of the guide protruding strip; and wherein the rotating cover is rotatably sleeved on the straight drinking nozzle through the guide blocks, the guide step and the guide protruding strip; and in the assembly state, the guide blocks and the movable holes are just aligned with each other, and the rotating cover moves upwards and drives the guide blocks to penetrate the movable holes.

3. The multifunctional double drinking cup cover according to claim 1, wherein first clamping blocks are arranged on the straight drinking nozzle, and a width of either of the first clamping blocks decreases in a direction away from the rotating cover;

wherein second clamping blocks are arranged on the inner side wall of the rotating cover, and a limiting groove is formed on the second clamping block; and wherein the first clamping blocks and the second clamping blocks are movable between a locking state and an unlocking state; in the locking state, the first clamping blocks are inserted into the limiting groove and abut against the second clamping blocks; and in the unlocking state, the first clamping blocks are detached from the limiting groove.

4. The multifunctional double drinking cup cover according to claim 3, wherein observation openings are formed on the rotating cover in a penetrating manner, and in the locking state, the observation openings and the first clamping blocks are just aligned with each other.

5. The multifunctional double drinking cup cover according to claim 1, wherein protruding blocks are arranged on the rotating cover.

6. The multifunctional double drinking cup cover according to claim 1, wherein a sealing ring is sleeved on the outer side wall of the straight drinking nozzle, and the inner side wall of the rotating cover abuts against the sealing ring.

7. The multifunctional double drinking cup cover according to claim 1, wherein an upper end of the straight drinking nozzle is inclined towards the button.

8. The multifunctional double drinking cup cover according to claim 1, further comprising a sealing gasket;

wherein a fixing column is arranged on the sealing gasket, a fixing hole is formed on the upper cover, and an upper end of the fixing hole is larger than a lower end thereof in width;

wherein the fixing column is elastic, the fixing column and the fixing hole are matched in shape, and the fixing column is inserted into the fixing hole for fitting in an inserted manner; and wherein in the closed state, the sealing gasket abuts against the upper surface of the rotating cover.

* * * * *